US008845452B2

(12) United States Patent
Sato

(10) Patent No.: US 8,845,452 B2
(45) Date of Patent: Sep. 30, 2014

(54) GOLF CLUB SHAFT

(71) Applicant: Bridgestone Sports Co., Ltd, Tokyo (JP)

(72) Inventor: Fumiaki Sato, Chichibu (JP)

(73) Assignee: Bridgestone Sports Co., Ltd, Tokyo (JP)

( * ) Notice: Subject to any disclaimer, the term of this patent is extended or adjusted under 35 U.S.C. 154(b) by 139 days.

(21) Appl. No.: 13/689,047

(22) Filed: Nov. 29, 2012

(65) Prior Publication Data

US 2013/0143688 A1 Jun. 6, 2013

(30) Foreign Application Priority Data

Dec. 2, 2011 (JP) ..... 2011-264849

(51) Int. Cl.
*A63B 53/10* (2006.01)

(52) U.S. Cl.
USPC ..... 473/319

(58) Field of Classification Search
CPC ..... A63B 53/10; A63B 53/12
USPC ..... 473/316–323, 287
See application file for complete search history.

(56) References Cited

U.S. PATENT DOCUMENTS

| | | | | | |
|---|---|---|---|---|---|
| 5,947,839 | A | | 9/1999 | Kusumoto | |
| 6,056,648 | A | * | 5/2000 | Kusumoto et al. | 473/319 |
| 6,322,458 | B1 | * | 11/2001 | Kusumoto et al. | 473/316 |
| 2013/0123039 | A1 | * | 5/2013 | Sato | 473/316 |

FOREIGN PATENT DOCUMENTS

| | | | | | |
|---|---|---|---|---|---|
| JP | 06-126005 | A | | 5/1994 | |
| JP | 08089605 | A | * | 4/1996 | A63B 53/10 |
| JP | 09-234256 | A | | 9/1997 | |
| JP | 10-043333 | A | | 2/1998 | |
| JP | 11-076481 | A | | 3/1999 | |
| JP | 11099230 | A | * | 4/1999 | A63B 53/10 |
| JP | 11164919 | A | * | 6/1999 | A63B 53/10 |
| JP | 2001104522 | A | * | 4/2001 | A63B 53/00 |
| JP | 2003135635 | A | * | 5/2003 | A63B 53/10 |
| JP | 2003199852 | A | * | 7/2003 | A63B 53/10 |
| JP | 2004-160057 | A | | 6/2004 | |
| JP | 2008-212340 | A | | 9/2008 | |
| JP | 2008212340 | A | * | 9/2008 | |

* cited by examiner

*Primary Examiner* — Stephen L. Blau

(74) *Attorney, Agent, or Firm* — Sughrue Mion, PLLC

(57) ABSTRACT

A golf club shaft has the bending rigidity distribution and the torsional rigidity distribution satisfying the following three relational formulas: 1) S2/S1≥2.5, wherein an average inclination of the bending rigidity in an interval from 400 mm to 700 mm from the front end of the shaft is defined as S1 and an average inclination of the bending rigidity in an interval from 800 mm to 950 mm from the front end of the shaft is defined as S2; 2) 1.0<EI/GI(mid)<1.5, wherein an average of the ratio of the bending rigidity with respect to the torsional rigidity in an interval from 300 mm to 700 mm from the front end of the shaft is defined as EI/GI(mid); and 3) EI/GI(900)≥1.75, wherein the ratio of the bending rigidity with respect to the torsional rigidity at a position 900 mm from the front end of the shaft is defined as EI/GI(900).

3 Claims, 4 Drawing Sheets

GOLF CLUB SHAFT

CROSS-REFERENCE TO RELATED APPLICATION

This Application claims priority from Japanese Patent Application No. 2011-264849 filed Dec. 2, 2011, which is incorporated herein by reference in its entirety.

BACKGROUND OF THE INVENTION

The present invention relates to a golf club shaft.

Conventionally, golf club shafts were designed with bending rigidity distribution to meet golfers' head speeds. For example, Japanese Patent Application Publication No. 2008-212340 disclosed a shaft which, by increasing a ratio of the bending rigidity on the grip end side of the shaft with respect to the bending rigidity on the front end side of the shaft within a predetermined range, enables an amateur golfer having a relatively slow head speed to hit a ball at a large launch angle and increase the travel distance.

SUMMARY OF THE INVENTION

There has been extensive research and development on designs for the bending rigidity distribution of conventional shafts. However, as for the torsional rigidity of the shaft (usually measured and evaluated as a torque), although there is some research and development directed to the torsional rigidity of an entire shaft length, the distribution of the torsional rigidity of the shaft has been little addressed. The shaft is formed in such a cylindrical shape that its diameter decreases toward the front end from the grip side. Therefore, usually, the torsional rigidity distribution of the shaft indicates the same increase and decrease as the bending rigidity distribution, and decreases gradually toward the front end from the grip end of the shaft. That is, when a golfer swings a golf club, the torsion of the shaft occurs mainly on the front end side of the shaft. A professional golfer feels no problem in the shaft having such a torsional rigidity distribution.

As a result of research on the torsional rigidity distribution of the shaft, the inventor of the present invention has found that, by setting the distribution of the torsional rigidity in a different distribution from the bending rigidity distribution, a golfer can make an impact timing more easily, and that the initial speed of a golf ball and the travel distance are improved.

That is, the present invention intends to provide a golf club which enables an amateur golfer to make an impact timing more easily and which can intensify the initial speed and the travel distance of a golf ball.

To achieve the aforementioned object, a golf club shaft has a bending rigidity distribution and a torsional rigidity distribution, and, regarding the bending rigidity distribution and the torsional rigidity distribution, 1) when an average inclination of the bending rigidity in an interval from 400 mm to 700 mm from the front end of the shaft is defined as S1 and an average inclination of the bending rigidity in an interval from 800 mm to 950 mm from the front end of the shaft is defined as S2, a relationship of S2/S1≥2.5 is satisfied; 2) when an average value of the ratio of the bending rigidity with respect to the torsional rigidity in an interval from 300 mm to 700 mm from the front end of the shaft is defined as EI/GI(mid), a relationship of 1.0<EI/GI(mid)<1.5 is satisfied; 3) when a ratio of the bending rigidity with respect to the torsional rigidity at a position 900 mm from the front end of the shaft is defined as EI/GI(900), a relationship of EI/GI(900)≥1.75 is satisfied.

Preferably, the upper limit of S2/S1 satisfies the relationship S2/S1≤4.5. More preferably, the upper limit of the EI/GI (900) satisfies the relationship EI/GI(900)≤2.00.

According to the present invention, when the average inclination S2 of the bending rigidity on the grip end portion is set extremely high compared to the average inclination S1 of the bending rigidity at the central portion of the shaft, the shaft bows greatly toward the front end from the central portion, and hardness of the shaft can be felt on the grip end portion. On the other hand, usually, the torsional rigidity distribution indicates a distribution of increase and decrease like the bending rigidity distribution. By changing the ratios of the bending rigidity with the torsional rigidity between EI/GI(mid) and EI/GI(900) greatly as predetermined, the shaft is twisted greatly on the grip end portion. Consequently, when swinging a golf club, an amateur golfer can feel hardness on the grip end portion of the shaft, and because the shaft becomes more likely to be twisted than conventional ones, the amateur golfer can make an impact timing more easily and the initial speed and the travel distance of a golf ball are improved.

DESCRIPTION OF THE PREFERRED EMBODIMENTS

Figure 1:
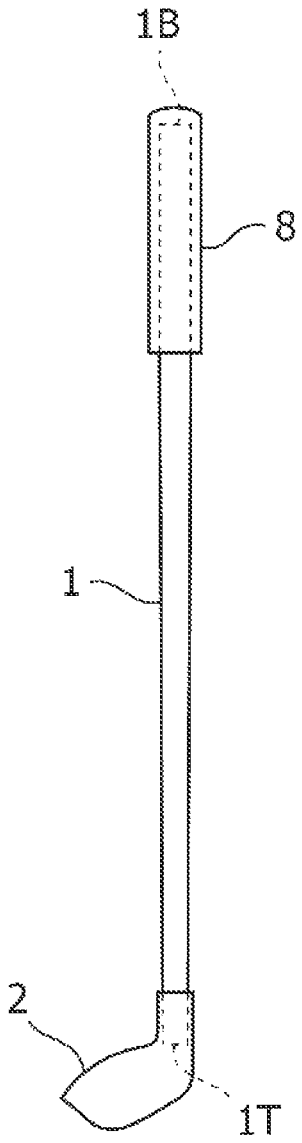
FIG. 1 is a schematic view showing an example of a golf club according to the present invention.

Hereinafter, an embodiment of a golf club according to the present invention will be described with reference to the accompanying drawings. As shown in FIG. 1, a golf club shaft 1 has a cylindrical shape in which the diameter thereof decreases gradually toward a front end 1T from a grip end 1B, and a head 2 is attached to the front end 1T of the shaft 1, and a grip 8 is attached to the grip end 1B in order to finish a golf club.

A required length of the shaft 1 may be defined as an ordinary length as a wood club shaft, and more particularly, is preferred to be 42.5 to 46.0 inches (1,080 to 1,168 mm). A required diameter of the shaft 1 may be defined in an ordinary diameter of the wood club shaft also. More specifically, the outside diameter on the grip end side is preferred to be 14.0 to 16.0 mm and the outside diameter on the front end side is preferred to be 8.5 to 9.5 mm. The weight of the shaft 1 is preferred to be in a range of 30 to 65 g as the wood club shaft, and is more preferred to be 40 to 60 g.

The shaft 1 has a predetermined bending rigidity distribution and a predetermined torsional rigidity distribution. First, the bending rigidity and the torsional rigidity will be described below.

Figure 2:
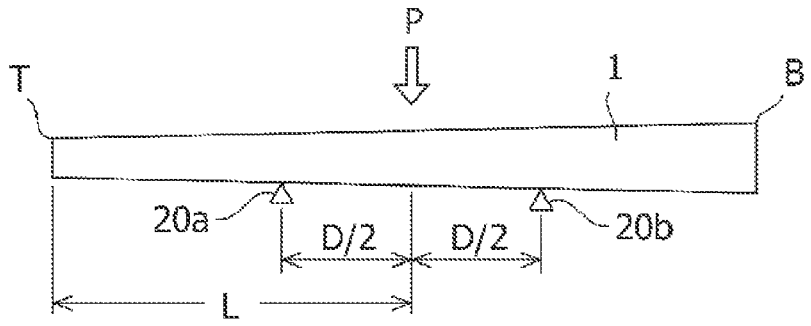
FIG. 2 is a schematic view for describing the method for measuring the bending rigidity of a golf club shaft.

The bending rigidity of the shaft 1 is expressed with a product EI of Young's modulus E and sectional second moment I. The value EI can be calculated according to a following formula 1 by performing a three-point test. For the three-point test of the shaft, as shown in FIG. 2, the shaft 1 is supported horizontally with a pair of supporting jigs 20 spaced at a predetermined gap D. Then, a load P is applied perpendicularly to the shaft 1 to the central position of an interval of the pair of the supporting jigs 20, that is, a measuring point for EI. At this measuring point, a strain amount σ of the shaft 1 at this measurement point is measured in order to obtain a value EI (unit: kgf·m$^2$). Usually, it is assumed that the distance D between the supporting jigs 20 is 0.3 m and the load P is 20 kg. The measurement point for the EI is expressed with a length T from the front end T of the shaft.

$$EI=(D^3/48)\cdot(P/\sigma) \quad \text{(formula 1)}$$

D: distance between a pair of supporting jigs [m]
P: load applied to shaft [kg]
σ: strain amount of shaft when a load is applied [m]

Figure 3A:
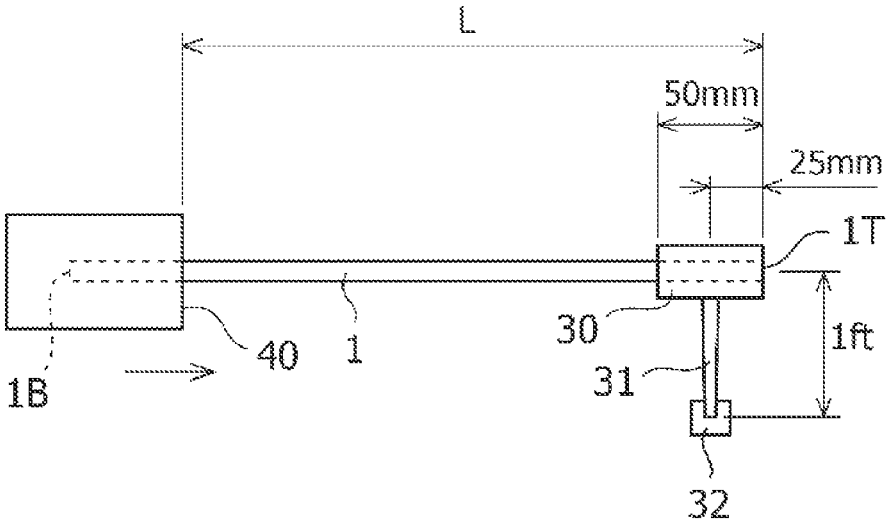
FIG. 3A is a plan view for describing a method for measuring a torque of a golf club shaft.
Figure 3B:
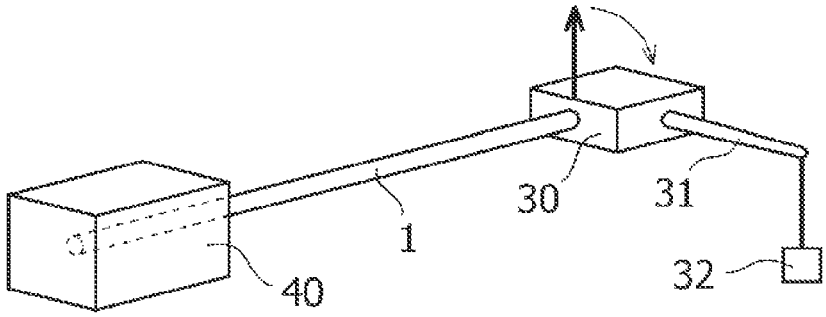
FIG. 3B is a perspective view for describing the method illustrated in FIG. 3A.

The torsional rigidity of the shaft 1 is expressed with GI. The value of GI can be calculated according to a following formula 2 by measuring a torque of the shaft 1. As for the measuring method for the torque, as shown in FIGS. 3A and 3B, a portion Lm and more far from the front end 1T of the shaft 1 is fixed with a fixing member 40 (that is, a measurement point for the GI is a length L from the front end T of the shaft), and a jig 30 having a length of 50 mm is attached to a portion 50 mm long from the front end 1T. An arm 31 having a length of 1 foot is provided at a central position of the jig 30, that is, at a position 25 mm from the front end 1T of the shaft 1 in a direction perpendicular to the longitudinal direction of the shaft. Then, a weight 32 having a weight of 1 pound is provided at the front end of the arm 31. Thus, the shaft 1 is twisted with a force of 1 foot·pound (0.1383 kgf·m) applied to a position 25 mm from the front end 1T. Then, a twisted angle θ of the shaft 1 is measured to obtain the value of GI (unit: kgf·m$^2$/rad). This angle θ is also called torque.

$$GI=Mt/\Phi \quad \text{(formula 2)}$$

$\Phi=\theta/L$
Mt: load (kgf·m)
θ: twisted angle (rad)
L: length up to fixing member from front end of shaft (m)

Figure 4:
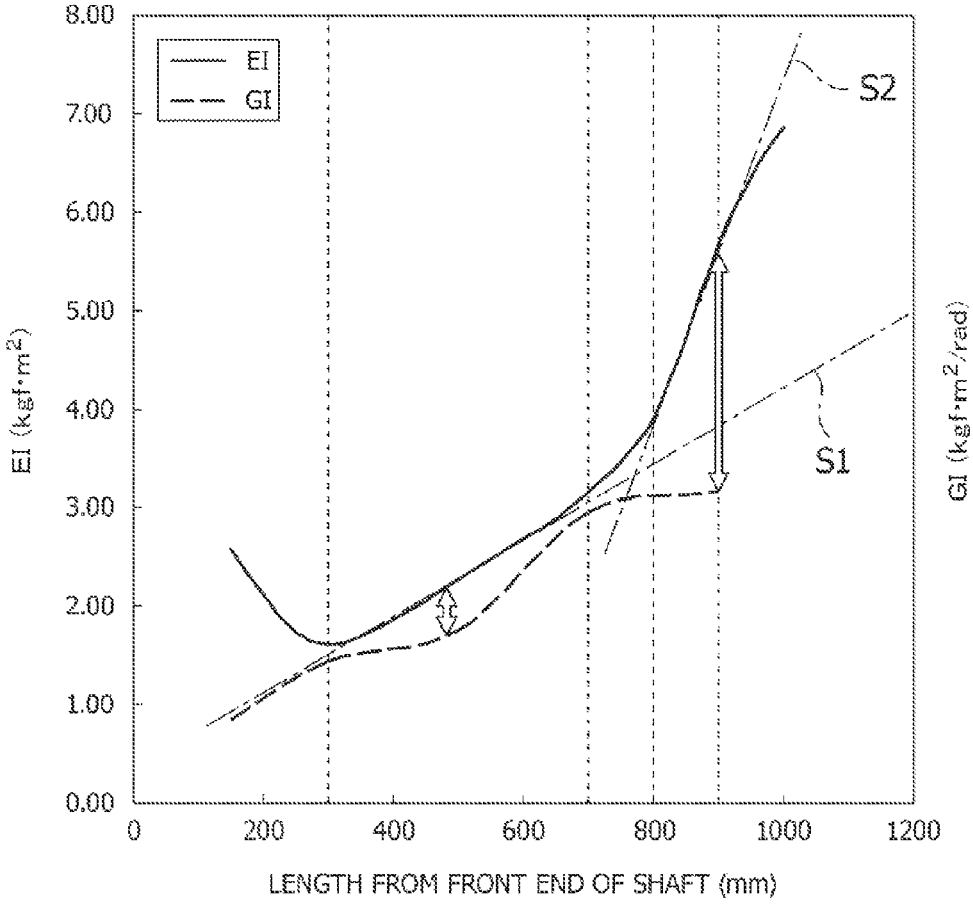
FIG. 4 is a graph indicating an example of the distributions of the bending rigidity EI and the torsional rigidity GI of the golf club shaft of the present invention.

By measurement for the torque by changing the measurement point (length L from the front end of the shaft) over the entire length of the shaft 1, a bending rigidity distribution and a torsional rigidity distribution of the shaft 1 can be obtained. FIG. 4 shows an example of the bending rigidity distribution and the torsional rigidity distribution of the shaft 1.

In the bending rigidity distribution, preferably, the bending rigidity EI increases monotonously in an interval from 400 mm to 700 mm in the length L from the front end of the shaft. This interval corresponds to substantially a central portion of the shaft 1 and an average inclination of the bending rigidity EI is called S1. Furthermore, in an interval from 800 mm to 950 mm in the length L from the front end of the shaft, it is preferable that the bending rigidity EI increases monotonously and an average inclination of the bending rigidity EI on a grip end portion of the shaft is called S2. The shaft 1 has a bending rigidity distribution of S2/S1≥2.5 in relationship between the two average tilts S1 and S2. The average inclinations S1, S2 can be obtained according to the regression line method.

Regarding a relationship between the bending rigidity distribution and the torsional rigidity distribution, assuming that an average value of the ratio of the bending rigidity EI with respect to the torsional rigidity GI in an interval from 300 mm to 700 mm in the length L from the front end of the shaft is called EI/GI(mid), the shaft 1 has a bending rigidity distribution and a torsional rigidity distribution which satisfy a relationship of 1.0<EI/GI(mid)<1.5.

Regarding the relationship between the bending rigidity distribution and the torsional rigidity distribution, assuming that a ratio of the bending rigidity EI with respect to the torsional rigidity GI at a position 900 mm in terms of the length L from the front end of the shaft is called EI/GI(900), the shaft 1 has a bending rigidity distribution and a torsional rigidity distribution which satisfy a relationship of EI/GI(900)≥1.75.

When the average inclination S2 of the bending rigidity on the grip end portion is intensified extremely with respect to the average inclination S1 of the bending rigidity at the central portion of the shaft, the bending rigidity on the grip end portion becomes much higher than the bending rigidity at the central portion of the shaft. As a result, when a golfer swings a golf club downward, the golf club bows greatly toward the front end of the shaft 1 from the central portion thereof. On the other hand, usually, the torsional rigidity distribution indicates a similar increasing and decreasing distribution to the bending rigidity distribution. Although the torsional rigidity distribution is about similar to or slightly lower than the bending rigidity distribution at the central portion of the shaft, the torsional rigidity distribution on the grip end portion does not increase as greatly as the bending rigidity distribution. Instead, the torsional rigidity is kept lower unlike the bending rigidity distribution which increases greatly, so that, when a golfer swings the golf club, the shaft becomes more likely to be twisted on the grip end portion than conventional shafts. Thus, when swinging the golf club, an amateur golfer can feel hardness on the grip end portion of the shaft, and, on the other hand, because the shaft is twisted greatly, the amateur golf can make an impact timing more easily and increase the initial speed and the travel distance of a golf ball.

The relationship between the average inclinations S1 and S2 of the bending rigidity is preferred to be S2/S1≥2.7, and more preferred to be S2/S1≥3.0. Although the upper limit of S2/S1 is not restricted to any particular value, S2/S1≤4.5 is preferred and S2/S1≤4.0 is more preferred. Furthermore, the relationship between the bending rigidity and the torsional rigidity at the central portion of the shaft is preferred to be 1.0<EI/GI(mid)<1.3, and is more preferred to be 1.1<EI/GI(mid)<1.3. Although the upper limit of EI/GI, which is the relationship between the bending rigidity and the torsional rigidity on the grip end portion of the shaft, is not restricted to any particular value, EI/GI(900)≤2.00 is preferred, and EI/GI(900)≤1.90 is more preferred.

As for the bending rigidity distribution, the bending rigidity at a position 900 mm in terms of the length L from the front end of the shaft is preferred to be 4.5 kgf·m$^2$ or more, is more preferred to be 5.0 kgf·m$^2$, and is further preferred to be 5.5 kgf·m$^2$. Furthermore, the bending rigidity at a position 300 mm in terms of the length L from the front end of the shaft is preferred to be 2.0 kgf·m$^2$ or less, is more preferred to be 1.8 kgf·m$^2$ or less, and is further preferred to be 1.7 kgf·m$^2$ or less.

In measurements of the bending rigidity and the torsional rigidity, the more the number of measuring points in the entire length of the shaft 1, the more accurate bending rigidity distribution and torsional rigidity distribution can be obtained. For example, in the bending rigidity distribution, a sufficiently accurate bending rigidity distribution can be obtained at eight positions 150 mm, 300 mm, 400 mm, 500 mm, 700 mm, 800 mm, 900 mm, and 950 mm in terms of the length L from the front end of the shaft. As for the torsional rigidity distribution, a sufficiently accurate torsional rigidity distribution can be obtained at five positions 150 mm, 300 mm, 500 mm, 700 mm, and 900 mm in terms of the length L from the front end of the shaft.

The shaft 1 is produced according to Sheet-Winding method. If explaining in detail, a prepreg sheet of fiber reinforced plastic (FRP) is wound around a mandrel (not shown) and hardened by heating, and the mandrel is pulled out of the hardened product to finish the shaft 1. As the reinforced fiber for the fiber reinforced plastic, it is permissible to use carbon fiber alone or composite fiber made of carbon fiber and other material fibers, or metallic fiber. Furthermore, as a matrix resin, thermoplastic resin such as epoxy resin may be used.

In the prepreg sheet for use, its fibers are oriented substantially in a single direction. When the fibers are arranged in parallel to the axis line of the shaft, a straight layer is formed, and when the fibers are arranged obliquely, a bias layer is formed. The prepreg sheet for the bias layer is oriented, for example, at an angle of 45° with respect to the axis line of the shaft. Usually, the prepreg sheets for the bias layer, in which the orientation angles of their fibers are in opposite inclinations to each other, are wound into two layers with an amount corresponding to half a circumference shifted relative to each other.

The prepreg sheet includes a main sheet having the same length as the entire length of the shaft 1 and a reinforcement sheet shorter than the entire length of the shaft. Because the mandrel is tapered such that the diameter thereof increases toward the grip end from the front end, the main sheet is formed in a trapezoidal shape in which the side on the grip end side is longer in order to allow a predetermined circumference of the sheet to be wound equally around the mandrel. The main sheet for the straight layer may be formed into a pentagonal shape by cutting a side of the trapezoid midway in order to reduce the number of windings on the grip end side compared to the front end side. Although the reinforcement sheet may be formed into the trapezoidal shape also, it may be formed into a rectangle or a triangle by forming the side on the grip end side in an oblique shape in order to obtain a predetermined bending rigidity. Usually, as the reinforcement sheet, the straight layer is formed.

To produce a shaft having torsional rigidity distribution, which the present invention proposes, independently of the bending rigidity distribution which is intensified on the grip end portion remarkably compared to the central portion of the shaft, the main sheet for the bias layer is formed into a trapezoidal shape in which the side on the grip end side is shorter than ordinary trapezoids, in order to decrease the number of windings on the grip end side gradually compared to the front end side. When using a prepreg sheet having such a configuration, the bias layer of the shaft 1 is formed gradually thinner toward the grip end side. Consequently, with the bending rigidity on the grip end portion of the shaft intensified, the torsional rigidity can be reduced.

Example

Shafts 1 to 4 of the first to fifth examples and comparative examples 1 to 4 having a bending rigidity distribution shown in Table 1 and a torsional rigidity distribution shown in Table 2 were produced and tested by hitting a ball. Table 3 shows a ball travel distance at that time and a sensory evaluation by a golfer who hit a ball with the golf club. Table 3 indicates S1 calculated from the bending rigidity distribution and the torsional rigidity distribution of Tables 1 and 2 (average inclination of the bending rigidity in an interval from 400 mm to 700 mm in the length L from the front end of the shaft), S2 (average inclination of the bending rigidity in an interval from 800 mm to 950 mm in the length L from the front end of the shaft), S2/S1, EI/GI (mid) (average value of a ratio of the bending rigidity with respect to the torsional rigidity at each position 300 mm, 500 mm, and 700 mm from the front end of the shaft), and EI/GI(900) (a ratio of the bending rigidity with respect to the torsional rigidity at a position 900 mm from the front end of the shaft). In addition, the same head was combined with all the shafts.

TABLE 1

| | Length L from front end of shaft (mm) | | | | | | | | | | | | | | | | | |
|---|---|---|---|---|---|---|---|---|---|---|---|---|---|---|---|---|---|---|
| | 150 | 200 | 250 | 300 | 350 | 400 | 450 | 500 | 550 | 600 | 650 | 700 | 750 | 800 | 850 | 900 | 950 | 1000 |
| Example 1 | 2.58 | 2.13 | 1.74 | 1.61 | 1.70 | 1.87 | 2.06 | 2.26 | 2.47 | 2.70 | 2.90 | 3.17 | 3.48 | 3.91 | 4.73 | 5.68 | 6.36 | 6.86 |
| Example 2 | 2.11 | 1.85 | 1.69 | 1.62 | 1.69 | 1.86 | 2.08 | 2.32 | 2.58 | 2.84 | 3.11 | 3.42 | 3.85 | 4.33 | 5.36 | 6.36 | 7.03 | 7.35 |
| Example 3 | 2.34 | 1.90 | 1.59 | 1.48 | 1.48 | 1.59 | 1.79 | 1.98 | 2.18 | 2.39 | 2.59 | 2.78 | 2.99 | 3.40 | 4.05 | 4.65 | 5.02 | 5.31 |
| Example 4 | 2.49 | 1.93 | 1.57 | 1.51 | 1.60 | 1.81 | 2.12 | 2.42 | 2.69 | 2.98 | 3.25 | 3.56 | 3.84 | 4.33 | 5.07 | 6.25 | 7.03 | |
| Comparative example 1 | 1.64 | 1.54 | 1.60 | 1.79 | 2.01 | 2.21 | 2.34 | 2.44 | 2.61 | 2.84 | 3.13 | 3.41 | 3.70 | 3.95 | 4.15 | 4.69 | 5.07 | |
| Comparative example 2 | 2.11 | 1.90 | 1.72 | 1.65 | 1.74 | 1.91 | 2.50 | 2.80 | 3.20 | 3.60 | 4.00 | 4.40 | 4.80 | 5.20 | 5.60 | 6.00 | 6.40 | 6.80 |
| Comparative example 3 | 2.05 | 1.88 | 1.76 | 1.68 | 1.52 | 1.55 | 1.76 | 2.01 | 2.30 | 2.85 | 3.30 | 3.80 | 4.13 | 4.38 | 4.65 | 4.87 | 5.04 | 5.20 |
| Comparative example 4 | 2.26 | 1.99 | 1.81 | 1.76 | 1.86 | 2.06 | 2.29 | 2.55 | 2.83 | 3.16 | 3.46 | 3.76 | 4.14 | 4.61 | 5.41 | 6.15 | 6.58 | 6.70 |

TABLE 2

| | Length L from front end of shaft (mm) | | | | |
|---|---|---|---|---|---|
| | 150 | 300 | 500 | 700 | 900 |
| Example 1 | 0.85 | 1.44 | 1.76 | 2.96 | 3.17 |
| Example 2 | 1.02 | 1.44 | 1.78 | 2.59 | 3.61 |
| Example 3 | 0.88 | 1.32 | 1.45 | 2.34 | 2.50 |
| Example 4 | 0.99 | 1.44 | 1.76 | 3.17 | 3.50 |
| Comparative example 1 | 0.57 | 0.99 | 1.44 | 2.26 | 2.64 |
| Comparative example 2 | 0.57 | 1.10 | 1.54 | 3.12 | 5.28 |
| Comparative example 3 | 1.49 | 0.99 | 1.53 | 2.26 | 3.87 |
| Comparative example 4 | 0.85 | 1.44 | 1.76 | 2.76 | 3.17 |

TABLE 3

| | S1 | S2 | S2/S1 | EI/GI (mid) | EI/GI (900) | Travel distance | Sensory evaluation |
|---|---|---|---|---|---|---|---|
| Example 1 | 4.30 | 16.61 | 3.86 | 1.16 | 1.79 | 5 | 5 |
| Example 2 | 5.18 | 18.22 | 3.52 | 1.25 | 1.76 | 4 | 5 |

TABLE 3-continued

| | S1 | S2 | S2/S1 | EI/GI (mid) | EI/GI (900) | Travel distance | Sensory evaluation |
|---|---|---|---|---|---|---|---|
| Example 3 | 3.98 | 10.95 | 2.75 | 1.22 | 1.86 | 4 | 4 |
| Example 4 | 5.78 | 18.59 | 3.22 | 1.18 | 1.79 | 5 | 4 |
| Comparative example 1 | 3.97 | 7.79 | 1.96 | 1.67 | 1.78 | 1 | 3 |
| Comparative example 2 | 8.05 | 8.00 | 0.99 | 1.58 | 1.14 | 2 | 4 |
| Comparative example 3 | 7.62 | 4.40 | 0.58 | 1.56 | 1.26 | 3 | 2 |
| Comparative example 4 | 5.77 | 13.29 | 2.30 | 1.34 | 1.94 | 4 | 2 |

The travel distances in Table 3 were evaluated according to five grades in which 5 is the highest and 1 is the lowest. The sensory evaluation by a golfer concerns the degree of easiness of making an impact timing, and was implemented according to the five grades in which 5 is the highest and 1 is the lowest.

As indicated in Table 3, the clubs of first to fourth examples were evaluated as 4 or higher in the travel distance and the sensory test. Particularly regarding the first example, the golfer evaluated the club saying that its shaft provided a feeling of bowing strongly so that he could swing the club without a feeling of unreliability.

On the other hand, in the comparative example 1 in which the S2/S1 was lower than the first to fourth examples and the EI/GI(mid) was higher than those examples, the travel distance was not improved. In the sensory test, the golfer evaluated the club saying that he felt hardness in the entire shaft and it was difficult to make an impact timing. In the comparative example 2 in which the value S2/S1 of the bending rigidity distribution was much lower or almost 1 and the EI/GI(900) was lower than the EI/GI(mid), the golfer evaluated the club as excellent in the sensory test, saying that he could hit the ball at an excellent timing, although the shaft was slightly softer than the first example and he felt a lack of reliability; however, the travel distance was improved a little. In the comparative example 3 in which the S2/S1 of the bending rigidity distribution was much lower than the comparative example 2 and the EI/GI(mid) was lower than the EI/GI(900), the travel distance was improved slightly; however in the sensory test, the bowing of the shaft on the grip end portion was large, so that the golfer evaluated that it was difficult to make an impact timing. Furthermore, in the comparative example 4 in which the S2/S1 was not high enough although the EI/GI(900) was higher than the EI/GI(mid), the travel distance was improved. However, in the sensory test, the golfer evaluated that it was difficult to make an impact timing because the behavior of the head was felt greatly in an entire swing action.

What is claimed is:

1. A golf club shaft having a bending rigidity distribution and a torsional rigidity distribution satisfying the following three relational formulas:

$$S2/S1 \geq 2.5,$$

wherein an average inclination of the bending rigidity in an interval from 400 mm to 700 mm from the front end of the shaft is defined as S1 and that an average inclination of the bending rigidity in an interval from 800 mm to 950 mm from the front end of the shaft is defined as S2;

$$1.0 < EI/GI(\text{mid}) < 1.5,$$

wherein an average of the ratio of the bending rigidity with respect to the torsional rigidity in an interval from 300 mm to 700 mm from the front end of the shaft is defined as EI/GI(mid); and $$EI/GI(900) \geq 1.75,$$

wherein a ratio of the bending rigidity with respect to the torsional rigidity at a position 900 mm from the front end of the shaft is defined as EI/GI(900).

2. The golf club shaft according to claim 1, wherein a relationship of S2/S1≤4.5 is satisfied.

3. The golf club shaft according to claim 1, wherein a relationship of EI/GI(900)≤2.00 is satisfied.

* * * * *